United States Patent [19]

Groswith, III et al.

[11] 4,072,326

[45] Feb. 7, 1978

[54] WRAP-AROUND COVER FOR BOOKS

[75] Inventors: Charles T. Groswith, III, Los Altos; Ralph M. Woodley, Palo Alto, both of Calif.

[73] Assignee: Velo-Bind, Inc., Sunnyvale, Calif.

[21] Appl. No.: 706,496

[22] Filed: July 19, 1976

[51] Int. Cl.[2] ..... B42D 1/00; B42D 3/00

[52] U.S. Cl. ..... 281/29; 281/21 R

[58] Field of Search ..... 281/21 R, 29, 21 A, 281/15 R; 11/2

[56] References Cited

U.S. PATENT DOCUMENTS

| | | | |
|---|---|---|---|
| 3,330,718 | 7/1967 | James | 281/21 R X |
| 3,347,565 | 10/1967 | Konkel | 281/29 X |
| 3,730,560 | 5/1973 | Abildgaard et al. | 281/29 X |
| 3,879,783 | 4/1975 | Giulie | 281/21 R X |

FOREIGN PATENT DOCUMENTS

| | | | |
|---|---|---|---|
| 345,869 | 6/1960 | Switzerland | 281/29 |

*Primary Examiner*—Harland S. Skogquist
*Attorney, Agent, or Firm*—Julian Caplan

[57] ABSTRACT

A cover is provided around the spine of a book of the type bound together by two plastic binding strips positioned along the spine marginal edges of the core of the book, one strip having studs passing through holes in the sheets of the core and through holes in the second strip. The cover in the vicinity of the spine extends from under a first strip in a direction away from the spine, around the outside of the first strip, then outside the spine and over the outside of the second strip. Thus the spine is covered and the spine cover is locked under one of the binding strips which bind the core. The spine cover may be integral with one or both outside covers for the front and back of the book. In such instances, one outside cover is folded in a reverse fold punched with aligned holes through which the binding studs pass. Where a single cover covers both front and back, a single pressure sensitive adhesive coated end sheet, such as shown in U.S. Pat. No. 3,749,422, is bound into the core and caused to adhere to the inside of the second cover. In other constructions, no pressure sensitive end sheet is required but a portion of the spine cover is provided with pressure-sensitive adhesive (initially covered by removable release paper) and such adhesive adheres to the outside of both strips, to the spine of the core, and to the outside of a portion of the second cover near the spine.

14 Claims, 8 Drawing Figures

WRAP-AROUND COVER FOR BOOKS

This invention relates to a new and improved wrap-around cover for books, to the completed book and the method of making same. More particularly, the present invention comprises an improvement on the book illustrated in U.S. Reissue Pat. No. 28,202 in that a cover for the spine of the book as well as for the front and back covers of the book are provided, at least one edge of the spine cover being gripped between plastic binding strips along the spine edges of the book.

Books of the type shown in U.S. Reissue Pat. No. 28,202 have been commercially successful and various covers of paper and plastic materials have been bound by the same binding strips which bind the sheets of the book. In accordance with the present invention, a wrap-around cover is provided which conceals the spine edge, such spine cover being integral with, or separate from, one or both of the front and back covers of the book.

A feature of the invention is the fact that the spine cover is securely bound into the book. One edge of the spine cover is secured under one of the binding strips. The other edge of the spine cover is secured to the cover on the opposite end of the book by adhesive which is preferably pressure sensitive.

Another feature of the cover is the fact that the plastic binding strips are concealed by the cover and the front and back book covers and spine covering are integral.

Another feature of the invention is the fact that the spine cover may be printed with various legends including the title and author of the book and with ornamental designs which may be compatible with the printing on the front and back covers.

Other objects of the present invention will become apparent upon reading the following specification and referring to the accompanying drawings in which similar characters of reference represent corresponding parts in each of the several views.

Figure 1:
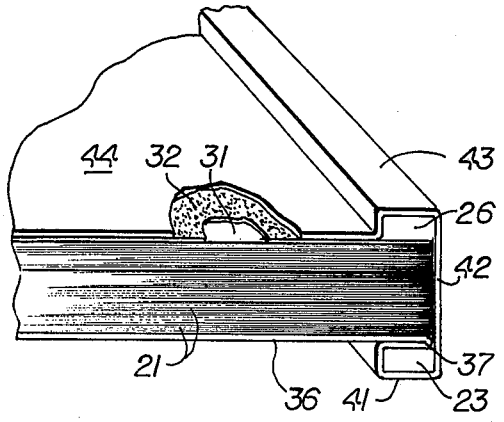
FIG. 1 is a fragmentary perspective view of the portion of a book partly broken away to reveal internal construction showing one form of cover applied to a book.

A book in accordance with U.S. Reissue Pat. No. 28,202 comprises a plurality of sheets 21 formed with holes 22 adjacent the spine margin of sheets 21 spaced apart along said marginal edge. A male binding strip 23, preferably thermoplastic, having a plurality of studs 24 dimensioned and spaced to fit into the holes 22 is provided. Similarly, a female binding strip 26 having holes 27 corresponding to the spacing of studs 22 and further preferably formed with counterbores 28 for holes 27 on the outside surface is likewise provided. Initially the studs 24 are preferably of a greater length than the thickness of the sheets 21 to be bound. By apparatus such as that shown in U.S. Pat. No. 3,811,146 the strips 23, 26 are compressed together, the excess lengths of the studs 24 are severed and heads 29 are formed on the severed ends of the studs filling the counterbores 28 and binding the book together. Similar or other binding strips and similar or other apparatus is used in accordance with the present invention.

In the form of the invention shown in FIG. 1, an end leaf 31 is bound into the book. Such an end leaf may be of the type shown in U.S. Pat. No. 3,749,422 in that it is provided with pressure-sensitive adhesive 32 on one outer face thereof (initially protected by release paper, not shown) and also has holes 33 matching the holes 22 of sheets 21.

Figure 2:
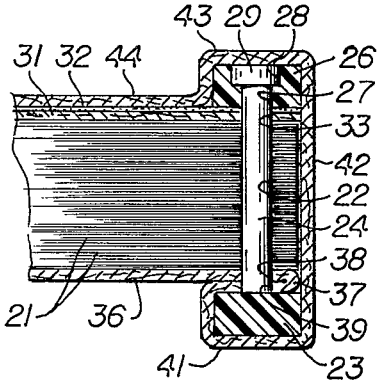
FIG. 2 is a fragmentary sectional view through a portion of the book of FIG. 1.

In the form of the invention shown in FIGS. 1 and 2 a single cover for the front and back of the book and for the spine is provided. Thus the first cover 36 for the front of the book is formed with a reverse fold 37 at the spine edge and holes 38 and 39 are formed in the cover 36 and in the reverse fold portion 37, said holes 38, 39 matching with the holes 22. Thus the studs 22 pass through holes 39 and 38 and securely bind the cover 36 along with sheets 21. A strip covering portion 41 extends from under the strip 23 around the outside thereof and joins the spine cover portion 42 which extends across the spine edge of the sheets 21. A second strip covering portion 43 joins the farthest edge of cover 42 and extends over the second strip 26. Portion 43 is integral with the back cover 44 and said back cover 44 is secured to end leaf 31 by the pressure-sensitive adhesive 32.

Thus in forming the book of FIGS. 1 and 2, at the time that the unbound pages are assembled, and end leaf 31 (covered by release paper) is positioned next to the female strip 26, then the sheets 21 and cover 36 are added and cover 44 is placed overlying same. The studs 24 of strip 23 are inserted through the holes 39, 38, 22, 33 and 27. Thereupon, the strips 23 and 26 are compressed together, the excess stud lengths of studs 24 are severed and the heads 29 formed. Thereupon, the portion 41 is brought around the outside of strip 23, the portion 42 around the outside of the spine of the book and the portion 43 around the outside of the strip 26. The release paper is stripped from the pressuresensitive adhesive 32 and the cover 44 caused to adhere to the end leaf 31. It will be understood that the position of the male and female strips 23, 26 may be reversed if desired. Assuming that the number of sheets 21 to be used in the book has been predetermined prior to the selection of the cover, the printing on the spine cover 42 may be centered and the size of the cover 36-44 selected so that it is unnecessary to trim the edges of the cover after formation of the book. However, when such dimensions are not predetermined, the outer edge (not shown) of cover 44 may be trimmed to correspond to the outer edges of the sheets 21 and of cover 36 and of end sheet 31.

Figure 3:
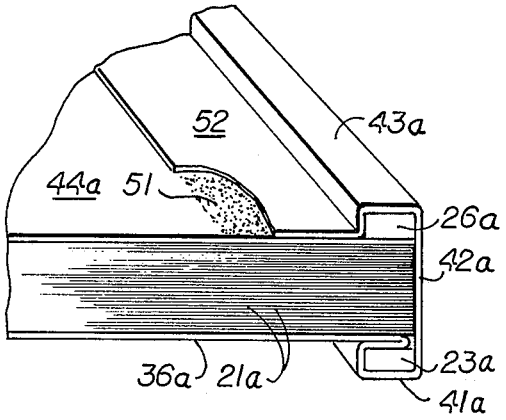
FIGS. 3 and 4 are views similar to FIGS. 1 and 2 respectively of a modified construction.
Figure 4:
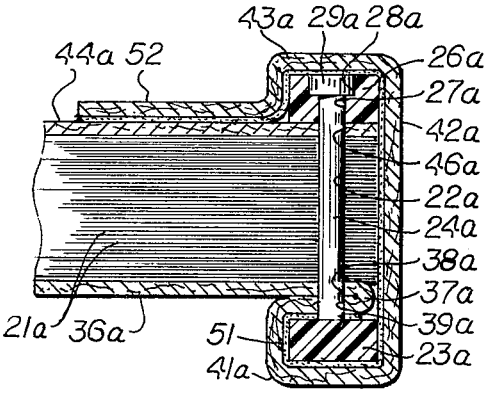

In the form of the invention shown in FIGS. 3 and 4, no end leaf similar to end leaf 31 of FIG. 1 is required. Instead, pressure-sensitive or other adhesive 51 is applied to the undersides of spine covering **42*a* and strip coverings 41*a*, 43*a* as well as to an overlap tab 52 which overlies the spine portion of the separate cover 44*a*. Thus the cover 44*a* with holes 46*a* is separate from the cover 36*a* and the portion thereof adjacent the spine of the book is concealed by the overlap 52. It will be understood that the adhesive 51 may be initially applied to the underside of overlap 52 and that optionally it may also be applied to the insides of coverings 41*a*, 42*a* and 43*a*. Alternatively, the adhesive 51 may be applied to the outside of the back cover 44***a*. In other respects, the construction of FIGS. 3 and 4 resembles that of FIGS. 1 and 2 and the same reference numerals followed by the subscript *a* are used to designate corresponding parts.

Figure 5:
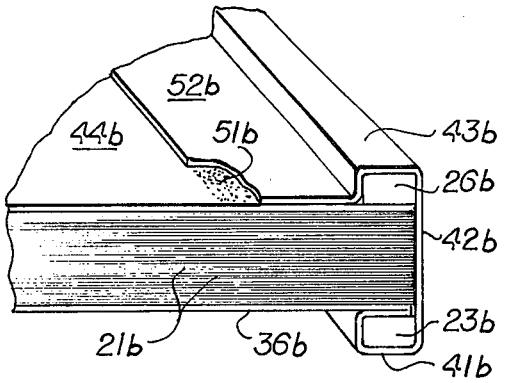
FIGS. 5 and 6 are views similar to FIGS. 1 and 2 respectively of a further modified construction.
Figure 6:
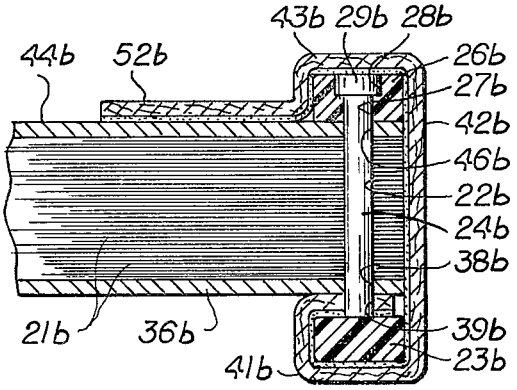

In the form of the invention shown in FIGS. 5 and 6, the covers 36*b* and 44*b* are separate from the spine cover 42*b*. In this form the invention, one edge of cover 42*b* is bound under strip 23*b* (or alternatively, under strip 26*b*) and is brought around the outside of strip 23*b* and first spine covering 41*b*, then across the spine in a spine covering 42*b* and then over the other strip 26*b* in a second spine covering strip portion 43*b* and then in a tab 52*b* overlying the spine edge of covering 44*b*. Again, the adhesive 51*b* is preferably formed on the insides of coverings 41*b*, 42*b* and 43*b* and 52*b* but alternatively may be initially applied to the spine edge of cover 44*b*. The form of invention shown in FIGS. 5 and 6 resembles that of the preceding modifications and the same reference numerals followed by subscript *b* are used to designate corresponding parts.

Figure 7:
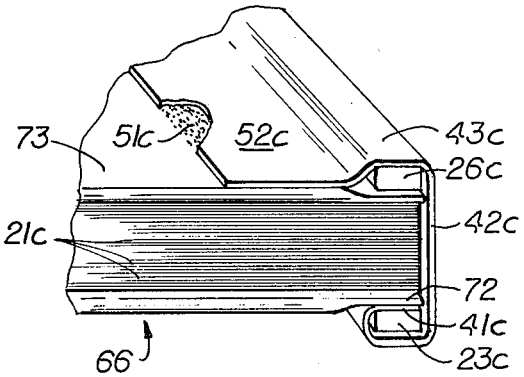
FIGS. 7 and 8 are views similar to FIGS. 1 and 2 of still another modified construction.

In the form of invention shown in FIGS. 7 nd 8, sheets 21*c* and end sheets 31*c* having pressure-sensitive adhesive 32*c* (initially covered by release paper, not shown) are bound by strips 23*c*, 26*c* as in the preceding modifications. In this modification, front cover 66 is covered with an outer layer 67 of vinyl, leather, cloth or other suitable material over cardboard 68. The edges 69 are turned in to conceal the cardboard along at least three edges of the cover. Board 68 terminates at an edge 71 spaced inward of the spine edge, leaving a thin portion 72 of covering material outward of edge 71 extending to the spine. Holes 73 are formed in this portion 72 for studs 24*c*.

Rear cover 73 is similar to front cover 66.

Figure 8:
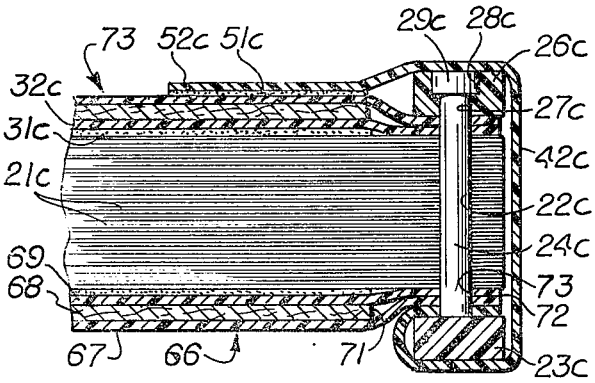

Spine cover 42*c* is preferably of a material similar to covering 67 (e.g. vinyl) and portion 41*c* is brought from under strip 23*c*, around the outside of strip 23*c*, over the spine of the book, over the outside of strip 26*c* and an overlap 52*c* lies over a portion of cover 73, to which it is attached by adhesive 51*c*. In other respects, the form of the invention of FIGS. 7 and 8 resembles that of the proceding modifications and the same reference numerals followed by subscript *c* designate corresponding parts.

What is claimed is:

1. A book comprising a plurality of sheets, a first end cover, a second end cover, a spine cover, a first binding strip overlying the spine margin of said first end cover, a second binding strip overlying the spine margin of said second end cover, cooperating binding means on said strips for securing said strips together, said sheets, both said end covers, said second binding strip and a first edge of said spine cover formed with aligned apertures spaced along the marginal edge of said book for reception of said binding means, said spine cover having said first edge bound under said first binding strip and being wrapped around an edge of said first strip opposite said spine, over the outside of said first strip, over the outside of the spine of said book, over the outside of said second strip and having an overlapping portion overlapping at least a portion of said second end cover, and means securing said overlapping portion to said at least a portion of said second end cover.

2. A book according to claim 1 in which said securing means comprises pressure sensitive adhesive.

3. A book according to claim 2 in which said adhesive also joins said spine cover to the outsides of said first and second strips and to the spine edges of said sheets.

4. A book according to claim 2 in which said securing means is applied to substantially the whole outer face of an end leaf of said book underlying said second end cover, said end leaf comprising said second end cover.

5. A book according to claim 1 in which said end covers and said spine cover are integral, said first cover formed with a reverse fold underlying said first strip, the portion of said first cover extending beyond said reverse fold comprising said spine cover.

6. A book according to claim 1 in which said first end cover and said spine cover are integral, said first cover formed with a reverse fold underlying said frist strip.

7. A book according to claim 1 in which said first and second end covers are separate from each other and from said spine cover.

8. A spine cover for a book of the type having a plurality of sheets, first and second end covers for said sheets, a first binding strip overlying the spine margin of said first end cover, a second binding strip overlying the spine margin of said second end cover, and cooperating binding means on said strips for securing said strips together, said sheets formed with first apertures longitudinally spaced apart at intervals and positioned inwardly of said spine margin, said spine cover having a first edge portion formed with second apertures positioned at the same intervals as said first apertures, said first edge portion shaped to fit from a location under said first strip, thence around the edge of said first strip opposite the spine, around the outside of said first strip, around the outside of said spine, around the outside of said second strip and having an overlapping portion adapted to overlap at least a portion of said second end cover.

9. A spine cover according to claim 8 which further comprises pressure sensitive adhesive on at least a portion of the inner surface of said spine cover.

10. A spine cover according to claim 8 in which said first cover and said spine cover are integral, said first cover formed with a reverse fold joining said first edge portion of said spine cover, said first cover formed with third apertures in registry with said second apertures.

11. A spine cover according to claim 10 in which said second cover is integral with said spine cover.

12. A method of binding a book comprising providing a plurality of sheets, a first and a second end cover, a spine cover, a first narrow binding strip and a second narrow bind strip, said binding strips having cooperating binding means projecting from at least said first binding strip at intervals, said sheets and end covers and said second binding strip being formed with first apertures spaced apart at said intervals along the spine margin of said book, said spine cover having an edge portion formed with second apertures, assembling said book with the apertures of said second strip, said second cover, said sheets, said first cover and said edge portion in registry, passing said cooperating means of said first strip through said second apertures and through all of said first apertures, securing said cooperating means of said first and second strips together to form a permanently bound book, wrapping said spine cover around the outside of said first strip, then around said spine, then around the outside of said second strip, and adhesively securing the portion of said spine cover opposite said first-mentioned edge portion to at least a portion of said second cover.

13. A method according to claim 12 in which said first cover and said spine cover are integral and said first cover is formed with a reverse fold and third apertures in registry with said second apertures, said method comprising initially folding said edge portion and spine cover overlying the outside of said first cover prior to insertion of said cooperating means.

14. A method according to claim 13 in which said second cover is integral with said spine cover and which further comprises providing an end leaf having adhesive on at least a portion of its outer surface and formed with fourth apertures in registry with said first apertures, said step of assembling said book further comprising positioning said end leaf on the outside of said sheets and under said second strip and said step of adhesively securing said spine cover to said second cover comprises adhering the adhesive of said end leaf to the underside of said second cover.

* * * * *